US008317164B2

(12) United States Patent
Ash

(10) Patent No.: US 8,317,164 B2
(45) Date of Patent: Nov. 27, 2012

(54) FENCE RAIL WITH CONCEALED FASTENER

(76) Inventor: Gary W Ash, Valley Center, CA (US)

( * ) Notice: Subject to any disclaimer, the term of this patent is extended or adjusted under 35 U.S.C. 154(b) by 114 days.

(21) Appl. No.: 12/754,863

(22) Filed: Apr. 6, 2010

(65) Prior Publication Data

US 2010/0252793 A1 Oct. 7, 2010

Related U.S. Application Data

(60) Provisional application No. 61/166,852, filed on Apr. 6, 2009.

(51) Int. Cl.
*E04H 17/00* (2006.01)

(52) U.S. Cl. ..... 256/67; 256/65.01

(58) Field of Classification Search ..... 256/22, 256/59, 65.01, 66, 67, 19, 21
See application file for complete search history.

(56) References Cited

U.S. PATENT DOCUMENTS 3,258,251 A 6/1966 Culter
3,414,236 A * 12/1968 Siegal ..... 256/22
3,506,243 A * 4/1970 Seiler ..... 256/59
3,596,880 A 8/1971 Greenberg
3,918,686 A * 11/1975 Knott et al. ..... 256/59
4,039,166 A 8/1977 Elgin
4,272,061 A * 6/1981 Suckno ..... 256/67
4,421,302 A * 12/1983 Grimm et al. ..... 256/67
4,642,953 A * 2/1987 DeGood ..... 52/183
4,805,879 A * 2/1989 Spera ..... 256/65.12
4,964,618 A 10/1990 Kennedy et al.
4,968,005 A * 11/1990 Zen ..... 256/22
5,165,643 A 11/1992 Shreiner
5,178,353 A 1/1993 Huxtable
5,288,048 A 2/1994 Shreiner
5,326,187 A 7/1994 St. Marie et al.
5,419,536 A 5/1995 Bender
5,458,942 A 10/1995 Miller
5,660,378 A 8/1997 Schall
5,758,987 A 6/1998 Frame et al.
5,853,167 A 12/1998 West et al.
6,029,954 A 2/2000 Murdaca
6,328,284 B2 12/2001 Wilding
6,375,166 B1 4/2002 Schall et al.
6,719,276 B1 4/2004 Bush
6,726,183 B2 4/2004 Wiley
6,752,385 B2 * 6/2004 Zen et al. ..... 256/65.01
6,863,265 B2 * 3/2005 Perry et al. ..... 256/65.07
6,874,766 B2 * 4/2005 Curatolo ..... 256/59
6,883,786 B2 4/2005 Bebendorf
6,893,008 B2 5/2005 Forbis
6,945,517 B2 9/2005 Augur
7,240,637 B2 7/2007 Rosen
D562,992 S * 2/2008 Szczekocki ..... D25/121
7,341,242 B2 3/2008 Bertato
7,384,025 B2 * 6/2008 Lo ..... 256/65.08
7,427,055 B2 9/2008 Platt
7,438,284 B2 * 10/2008 McGinness et al. ..... 256/59

(Continued)

*Primary Examiner* — Joshua Kennedy
(74) *Attorney, Agent, or Firm* — Eric A. Hanscom; Todd J. Langford

(57) ABSTRACT

A fence rail includes a detachable fastener cover that covers and conceals a fastener chamber. Through the use of a knuckle and a catch fastening system, moisture is prevented from entering the fastener chamber. The fastener chamber allows for securing pickets to the rail using a means for fastening as close to the top of the rail as possible thereby allowing for significant racking of the fence.

18 Claims, 6 Drawing Sheets

U.S. PATENT DOCUMENTS

| | | | | |
|---|---|---|---|---|
| 7,543,802 | B2 * | 6/2009 | Petta et al. | 256/65.08 |
| 7,562,864 | B2 | 7/2009 | Robbins, III | |
| 7,635,115 | B2 | 12/2009 | Lehmann | |
| 7,677,535 | B1 * | 3/2010 | Lo | 256/65.08 |
| 7,744,065 | B2 * | 6/2010 | Terrels et al. | 256/59 |
| 2007/0085065 | A1 | 4/2007 | Ramos | |
| 2007/0170410 | A1 | 7/2007 | Devine | |
| 2007/0272909 | A1 | 11/2007 | Payne | |
| 2008/0029747 | A1 * | 2/2008 | Lehmann | 256/65.01 |
| 2008/0173856 | A1 | 7/2008 | Payne | |
| 2009/0134377 | A1 * | 5/2009 | Petta et al. | 256/65.01 |
| 2009/0179183 | A1 * | 7/2009 | Ferris et al. | 256/67 |
| 2009/0194753 | A1 | 8/2009 | Stucker | |
| 2010/0155683 | A1 * | 6/2010 | Payne et al. | 256/67 |
| 2010/0200825 | A1 * | 8/2010 | Hill | 256/24 |
| 2010/0200827 | A1 * | 8/2010 | Duffy et al. | 256/67 |
| 2010/0252793 | A1 * | 10/2010 | Ash | 256/65.02 |
| 2010/0264388 | A1 * | 10/2010 | Duffy et al. | 256/22 |
| 2011/0001105 | A1 * | 1/2011 | Lo | 256/65.08 |
| 2011/0042637 | A1 * | 2/2011 | Howard et al. | 256/22 |
| 2011/0155982 | A1 * | 6/2011 | Duffy et al. | 256/22 |
| 2011/0233498 | A1 * | 9/2011 | Stinson | 256/65.01 |
| 2011/0233499 | A1 * | 9/2011 | Stinson | 256/65.01 |

* cited by examiner

FENCE RAIL WITH CONCEALED FASTENER

CROSS REFERENCE TO RELATED APPLICATIONS

This patent application is a nonprovisional of U.S. Provisional Patent Application No. 61/166,852 filed on Apr. 6, 2009, the entirety of which is hereby incorporated by reference.

STATEMENT REGARDING FEDERALLY SPONSORED RESEARCH OR DEVELOPMENT

This invention was not federally sponsored.

BACKGROUND OF THE INVENTION

Field of the Invention

This invention relates to the general field of fence rails, and more specifically toward a fence rail with concealed fastener. The fence rail includes a detachable fastener cover that covers and conceals a fastener chamber. Through the use of a knuckle and a catch fastening system, moisture is prevented from entering the fastener chamber. The fastener chamber allows for securing pickets to the rail using a means for fastening as close to the top of the rail as possible thereby allowing for significant racking of the fence.

Fences have been around for thousands of years. From delineating ownership of land to corralling animals, fences play an important role in everyday life. Because of the large demand for fences, there is a great need for versatile fencing materials that produce aesthetically pleasing fences. Construction of the fence should occur quickly and at minimal cost.

To this end, the prior art teaches fences made of extrudable material, such as aluminum. The materials are cheap and the parts of the fence can be manufactured with little cost. In one embodiment, a fence is created using posts, two or more rails, and a plurality of pickets. The posts are vertically secured to the ground, and the rails are horizontally secured between the posts. The pickets are then vertically secured to the one or more rails. In fence applications where the underlying ground is not level, the rails may be at an angle between posts, whereby the fence is racked as a parallelogram with the pickets remaining parallel with the posts.

There are, however, significant deficiencies in the prior art disclosures. Known designs have exposed fasteners on one side of the rail, an internal clip, a structurally fastened member inside of the rail, or a two or three sided top cover that snaps over the entire rail. These designs are unsightly, expensive to manufacture, expensive to construct, tend to rattle in the wind, susceptible to environmental elements, and/or not suitable for a variety of terrains.

For example, U.S. Pat. No. 7,635,115 to Lehmann teaches a fence rail assembly comprising an extruded rail having a lengthwise slot for receiving a plurality of fasteners for attaching the rail to a plurality of pickets. While the fastener that secures the picket to the rail is hidden, the fastener is secured to the middle of the rail therefore making it unsuitable for a variety of terrains, and is susceptible to environmental elements, such as rain and dust.

Other known fences or railings either have exposed fasteners that must face your home or your neighbor, or have a concealed fastener that causes rattle in the wind and prohibits the panels from being racked to steep hillsides. Racking a fence is where the rails substantially follow the slope of the terrain while the pickets and posts remain vertical. There are also other designs that rely on a clip or sliding member to hold the picket inside the rail. These designs may use a wire or rod that rides inside a channel formed into the extrusion. In these designs, the punch through the top of the rail is the only member keeping the picket from sliding freely on the rail. Relying on the punch to keep the picket from sliding causes the panel to bind up when attempting to rack steep hillsides as well as rattle in the wind. Some existing concealed fastener designs also use a non-replaceable captive rubber gasket to inhibit rattle. However, these gaskets are exposed to the weather and wear out with time, which causes future rattle. Existing concealed fastener designs also use a multi-channel design, which increases cost of production.

Thus there has existed a long-felt need for a fence rail with concealed fastener that is aesthetically pleasing. It should be inexpensive to manufacture and construct. The rails and pickets must allow for racking to track over uneven terrain, such as steep inclines. Further the fence rail with concealed faster should securely fasten the picket to the rail, thereby limiting rattle, as well as withstand variable environmental elements to render a reliable produce with a long usable life.

SUMMARY OF THE INVENTION

The current invention provides just such a solution by having a fence rail that includes a detachable fastener cover that covers and conceals a fastener chamber. Through the use of a knuckle and a catch fastening system, moisture is prevented from entering the fastener chamber. The fastener chamber allows for securing pickets to the rail using a means for fastening as close to the top of the rail as possible thereby allowing for significant racking of the fence.

The current invention relates to the solidity of using fasteners, and places a single sided snap cover (detachable fastener cover) over those fasteners to conceal them from view. The pivot knuckle design on the detachable fastener cover, with a dual plane snap for securely snapping on this cover. The knuckle provides for a drip edge for proper water shed, which prohibits water from wicking back into the fastener compartment.

It is a principal object of the invention to provide a fence rail with concealed fasteners.

It is another object of the invention to provide a fence rail where moisture is prevented from entering the fastener chamber.

It is a further object of this invention to provide a fence rail with a means of fastening that is close to the top of the rail thereby allowing for significant racking of the fence.

It is an additional object of this invention to provide a fence that is relatively inexpensive to manufacture.

It is yet another object of the invention to provide a fence that is relatively easy to construct.

It is a further object of the invention to provide a fencing system that allows for a large number of profiles to be created from a minimum number of unique parts.

It is a final object of the invention to provide a fence that has a single part for concealing fasteners to simplify manufacturing and construction.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims.

BRIEF DESCRIPTION OF THE FIGURES

The accompanying drawings, which are incorporated in and form a part of this specification, illustrate embodiments of the invention and together with the description, serve to explain the principles of this invention.

DETAILED DESCRIPTION OF THE INVENTION

Figure 1:
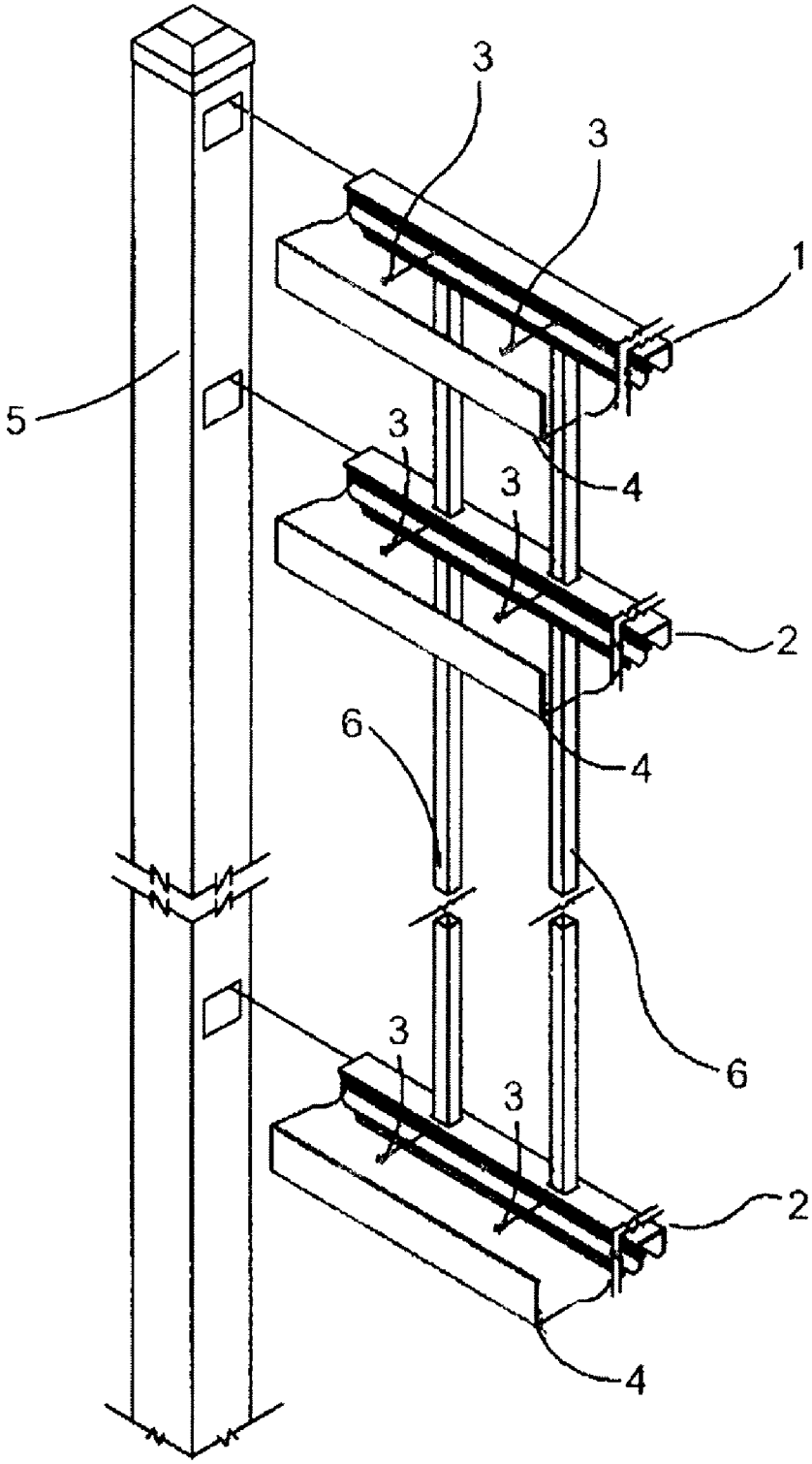
FIG. 1 is an exploded, perspective view of a portion of a fence according to an exemplary embodiment of the current invention.

Many aspects of the invention can be better understood with the references made to the drawings below. The components in the drawings are not necessarily drawn to scale. Instead, emphasis is placed upon clearly illustrating the components of the present invention. Moreover, like reference numerals designate corresponding parts through the several views in the drawings.

In one contemplated embodiment of the current invention, a single sided concealed fastener design allows for extreme racking of up to a 22 degree angle to the ground. Until now, such extreme racking could only be achieved by the prior art through the use of extra wide stamping of existing stringers. The single side concealed fastener according to the current invention also eliminates rattle and is more cost effective.

FIG. 1 is an exploded, perspective view of a portion of a fence according to an exemplary embodiment of the current invention. The fence has a header rail 1 and two stringer rails 2, both of which are typically manufactured through an extrusion process through a die and then cut to length. The rails are preferably made from aluminum, but could be made from steel or other materials including composite alloys and composite fiber based products. The fence may be designed for the purpose of dividing properties or limiting human or animal access to certain locations. The contemplated fence is intended to allow fastening of pickets 6 through one or more stringer rails 2 and a header rail 1 using a plurality of fasteners 3. The rails carry the vertical load of the fence and any additional load being applied between posts 5. The length of the rails is preferably about six feet long, but can be longer or shorter in length depending upon specific applications. In an exemplary embodiment, the fence system uses two stringer rails and one header rail, though the use of only one stringer rail and one header rail is also possible. In fact, the number of stringer and header rails may vary considerably depending upon the structural and aesthetic requirements of the fence. For example, particular applications may use three stringer rails and no header rails, or a plurality of stringer rails and a single header rail. The stringer rail 2 is normally punched on the top to allow the passage of the picket 6 through the stringer rail 2, while the header rail 1 is not punched to allow the passage of the picket 6. Therefore, most applications of the fence according to the current invention will include only a single header rail 1 with one or more stringer rails 2 between two posts 5. The fastener cover 4, which can be cut in varying lengths, is a removable cover that secures to the header rail 1 and stringer rail 2 by a snap action. The fastener cover 4 can be cut longer than the distance between the posts such that the fastener cover 4 enters the posts 5 with the rail, or can be cut the same as or shorter than the distance between the posts to allow for easier service access.

In its simplest form, invention includes two pieces that snap together to effectively conceal the fastener and rail holes from view; a rail and a fastener cover, where the fasteners are used to secure pickets to the rail and the fastener cover is used to cover the fasteners and screw holes. While screws are the most common type of fastener, other types of fasteners may be used without departing from the scope of the current invention. For example, locking pins, spring loaded protrusions, and bolts can also be used to secure the pickets to the rails.

The contemplated fastener cover and rail work together as a unit to effectively conceal the fasteners, which are considered unsightly by most people. Rails can be pre-drilled to allow the homeowner or contractor to mix and match picket and rail designs so as to easily achieve different styles of fence. This one sided cover allows for modular design, while maintaining the solidarity of using fasteners in the construction of the fence. One important aspect to this invention is the one-sided fastener cover design. By applying the fastener cover to only one side of the rail in a snap action design, the fastener cover can be easily removed for maintenance, repair, or modification to an alternate configuration. This one-sided cover also eliminates the problems associated with racking the fence. By using a rail configuration with a fastener and a single sided fastener cover, the sliding action of the picket within the rail caused by using a clip or fastening rail is eliminated. The fastener effectively allows the producer the ability to punch the picket hole wider for relief when raking steep inclines. This two-piece configuration also has a significant cost savings over existing clip or slide rail fastener designs.

In operation, after the fasteners attach the rail to the pickets, the user places the knuckle portion of the fastener cover into the rail lip. Then by squeezing the rail and fastener cover firmly together with his or her hands, the fastener cover will snap onto the rail. To remove, a user can simply pull up on the open channel side of the fastener cover at the snap dimple and pull the cover off to access to the fasteners. Alternatively, it is contemplated that the fastener cover be pivotably and detachably attached to the rails.

Figure 2:
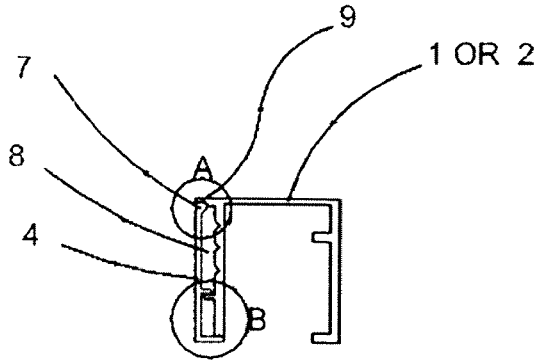
FIG. 2 is a cross-sectional view of a header rail or stringer rail according to an exemplary embodiment of the current invention.

FIG. 2 is a cross-sectional view of a header rail or stringer rail according to an exemplary embodiment of the current invention. The top of the fastener cover 4 utilizes a knuckle 7 that allows the cover to securely attach under the rail lip 9 and prohibits moisture from entering the fastener chamber 8 by drip edge design. The outside portion of the fastener cover should be finished such that it mimics the finish on the rail 1, 2. In fact, the outside portion of the fastener is preferably indistinguishable from the opposite side of the rail 1, 2. The top portion of the fastener cover secured to a rail, designated by A, and the bottom portion of the fastener cover secured to a rail, designated by B, are more clearly shown in FIG. 3. The top of the header rail 1 is preferably not punched. This prevents pickets from extending through the header rail as well as providing a more aesthetically pleasing fence. However, the top of the stringer rail 2 preferably includes a punched portion to allow the pickets to extend therethrough. The rail can also include several openings to allow for screws to pass therethrough thereby enabling the picket to secure at various vertical points to the rail and allowing for multiple style configurations.

Figure 3:
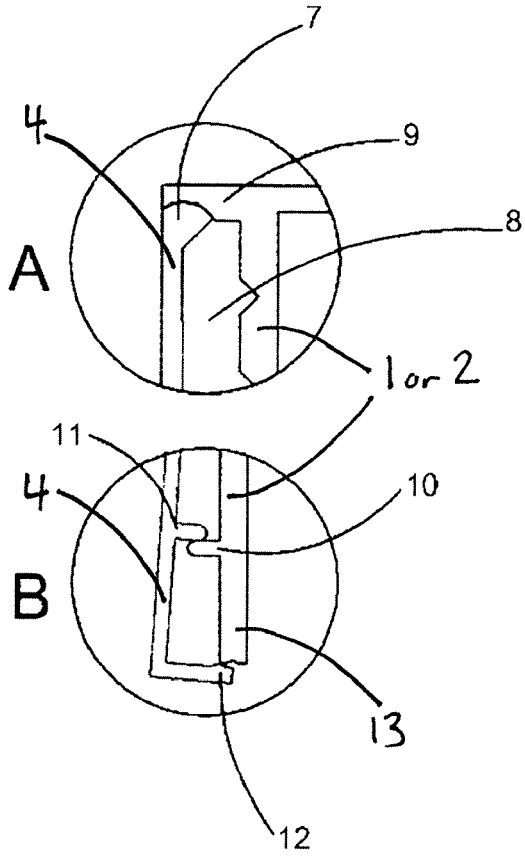
FIG. 3 is a close-up cross-sectional view of a fastener cover according to an exemplary embodiment of the current invention.

FIG. 3 is a close-up cross-sectional view of a fastener cover according to an exemplary embodiment of the current invention. Part A is the top portion while part B is the bottom portion. The fastener cover 4 includes a knuckle 7 that mates with a rail lip 9 of a rail 1, 2. The configuration of the knuckle/lip acts as to help secure the fastener cover to the rail as well as prevents the entrance of moisture, dirt, or other foreign objects into the screw chamber 8, also known as a fastener chamber. The fastener cover also includes a snap dimple 12 that mates with a snap divot 13 of the rail 1, 2. The rail includes a rib 10 that mates with a rib 11 from the fastener cover. When the fastener cover 4 is secured to the rail 1, 2, the mating of the ribs 10, 11 creates a compression point that allows the snap action to take place on parallel planes between two perpendicular members at snap dimple 12 and snap divot 13. In this fashion, a user can slide the knuckle 7 of the fastener cover into the rail lip and rotate the cover into place until the ribs 10, 11 meet and create a compression force, and then snap the snap dimple 12 into the snap divot 13. The knuckle 7 and additional perpendicular surfaces of the cover increase the rigidity of the cover and therefore result in reduce shipping costs when compared to existing cover designs. Rigid packaging is required to ship prior art covers, while the fastener cover according to the current invention can be shipping in semi-rigid packaging, such as cardboard, to reduce packaging and shipping costs.

In an alternative embodiment, the knuckle 7 and rail lip 9 are replaced with a means of pivotally attaching the fastener cover to the rail. For example, the top of the fastener cover can coaxially attach around a cylinder of the rail. This would allow the fastener cover to rotate about the attachment point. It can be rotated to an open position to allow for access to the screw chamber, and snapped close using the ribs 10,11, snap dimple 12, and snap divot 13.

In many circumstances a fence must traverse an incline, or be racked. To achieve this, the pickets must extend up and through the stringer rails in a non-perpendicular fashion; in other words, the pickets must extend at an angle of less than 90 degrees through the rail.

Figure 4:
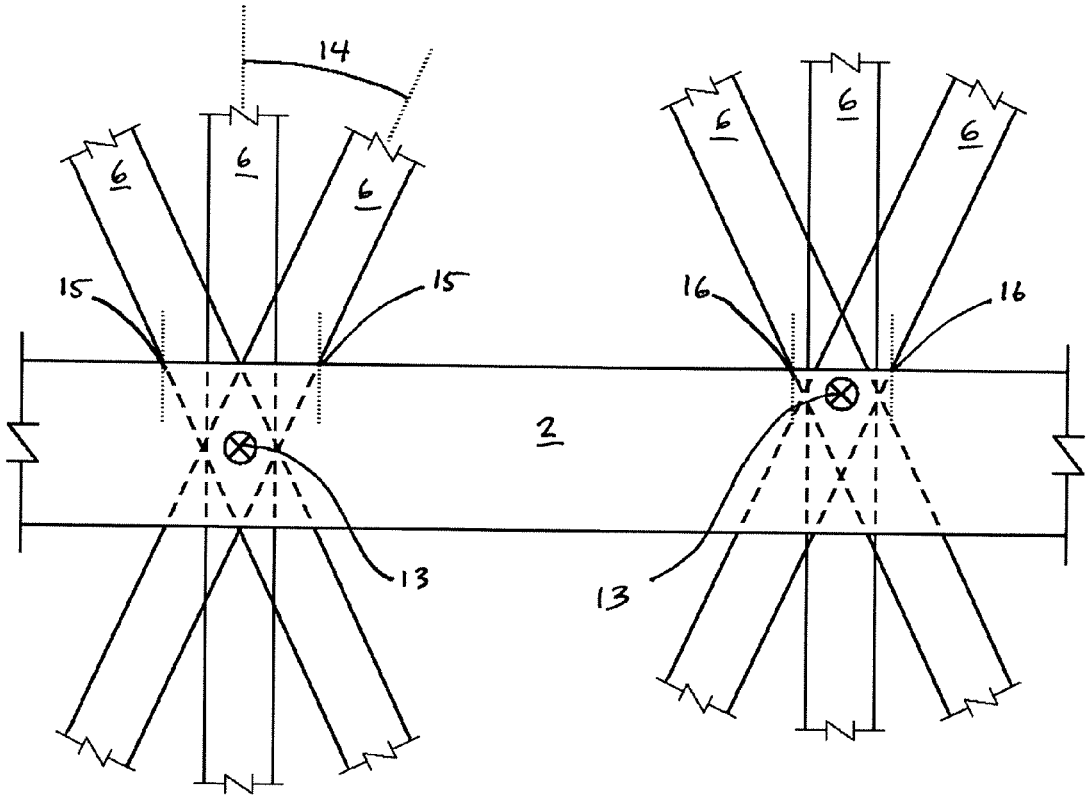
FIG. 4 is a side view of a stringer rail and pickets in different configurations illustrating differences between existing designs and the current invention.

FIG. 4 is a side view of a stringer rail and pickets in different configurations. As described above, the stringer rail 2 includes a web portion on the top, but not the bottom. Thus, for the picket to extend through the stringer rail 2, the top web must be punched. When a fence is racked, such as when it traverses an incline, the pickets are angled relative to rails. However, the angling of the pickets relative to the rail requires a larger punched hole in the web of the rail. Smaller punched holes in the web of the rail are preferable. The smaller holes are more aesthetically pleasing and result in greater stability of the rail and overall fence.

Pickets secured closer to the top of the rail require a smaller sized hole through which to pass. The left side of FIG. 4 shows pickets 6 secured to the middle of the stringer rail 2 using a fastener 3. The right side of FIG. 4 shows pickets 6 secured to the top of the stringer rail 2 using a fastener 3. The angle 14 of the rotated pickets 6 is approximately 25 degrees. The areas between dashed lines 15 and 16 represent areas of the web that must be punched to allow the angled pickets to pass through. The distance between dashed lines 15 is greater than the distance between dashed lines 16. From this, it is shown that pickets secured closer to the top of the rail require a smaller punched hole through the top web than pickets secured further down the rail.

Figure 5:
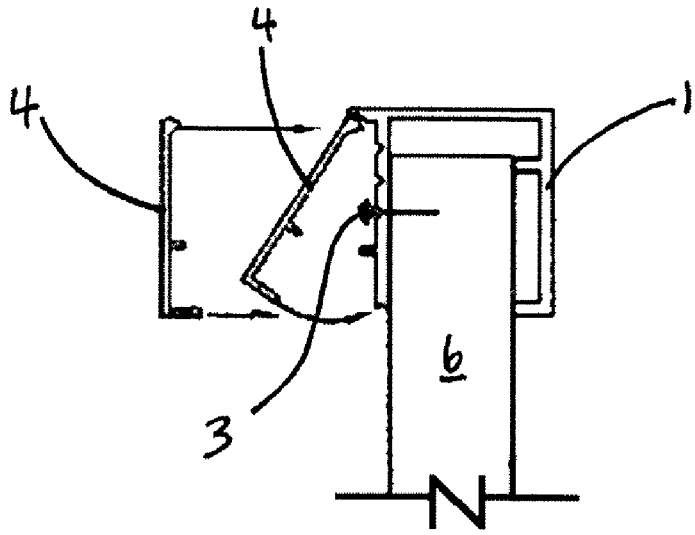
FIG. 5 is a cross-sectional view of a fastener cover being secured to a header rail according to an exemplary embodiment of the current invention.

FIG. 5 is a cross-sectional view of a fastener cover being secured to a header rail according to an exemplary embodiment of the current invention. In this view, a picket 6 extends up into a header rail 1. The picket 6 is secured to the middle of the rail 1 by means of a fastener 3, preferably a screw. After the picket is secured to the rail, a fastener cover 4 is snapped over the rail 1.

Figure 6:
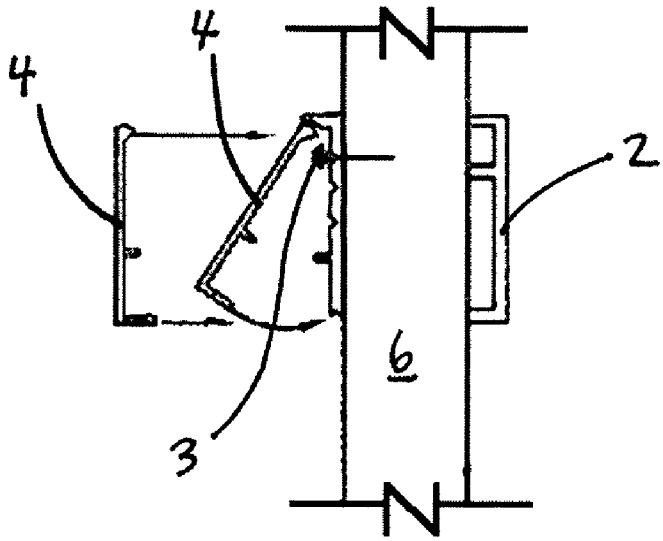
FIG. 6 is a cross-sectional view of a fastener cover being secured to a stringer rail according to an exemplary embodiment of the current invention.

FIG. 6 is a cross-sectional view of a fastener cover being secured to a stringer rail according to an exemplary embodiment of the current invention. In this view, a picket 6 extends up through a stringer rail 2. The picket 6 is secured to the top of the stringer rail 2 to allow the picket to rotate and the fence to rack up an incline. After the picket is secured to the rail, a fastener cover 4 is snapped over the rail 1.

Figure 7:
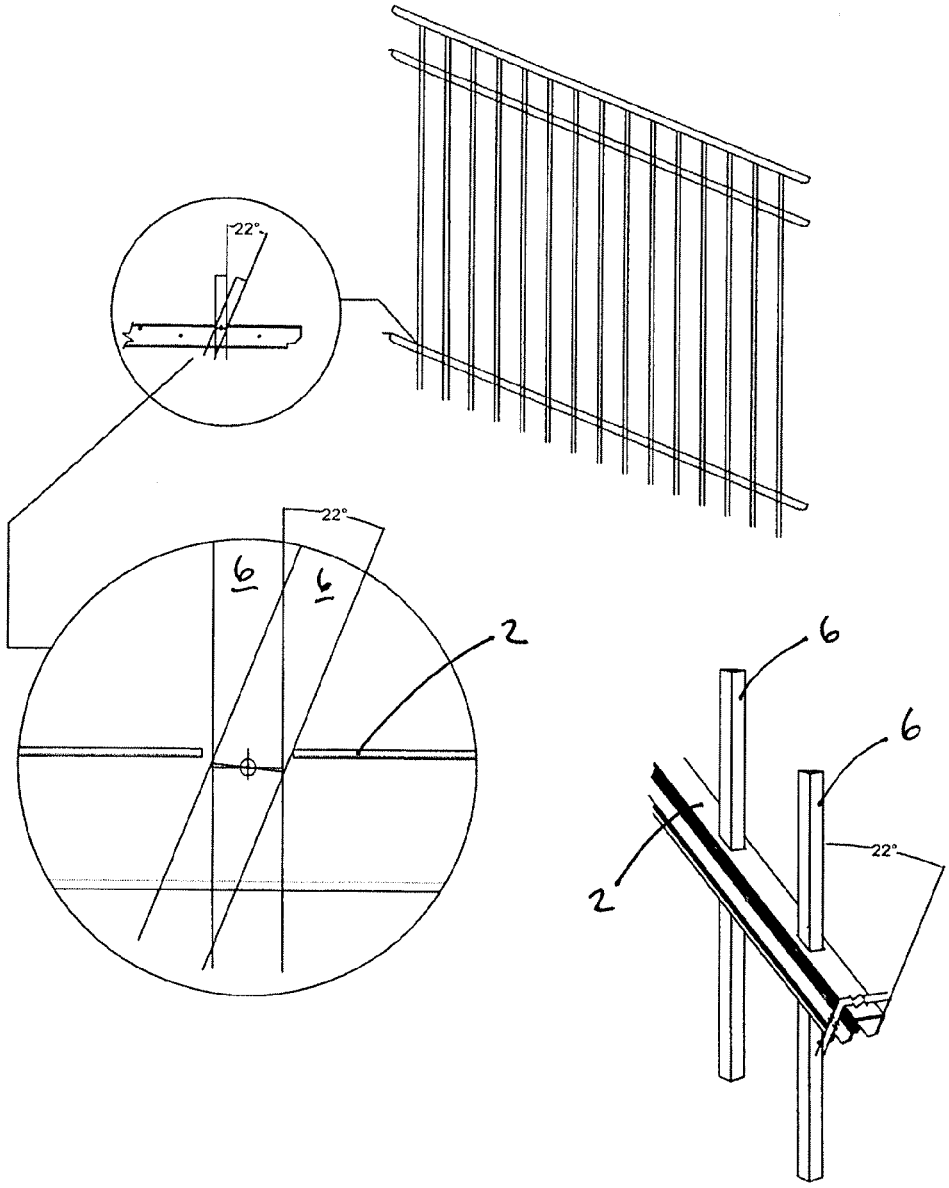
FIG. 7 is a perspective view of a racked fence according to an exemplary embodiment of the current invention showing pickets fastened near the top of a rail.
Figure 8:
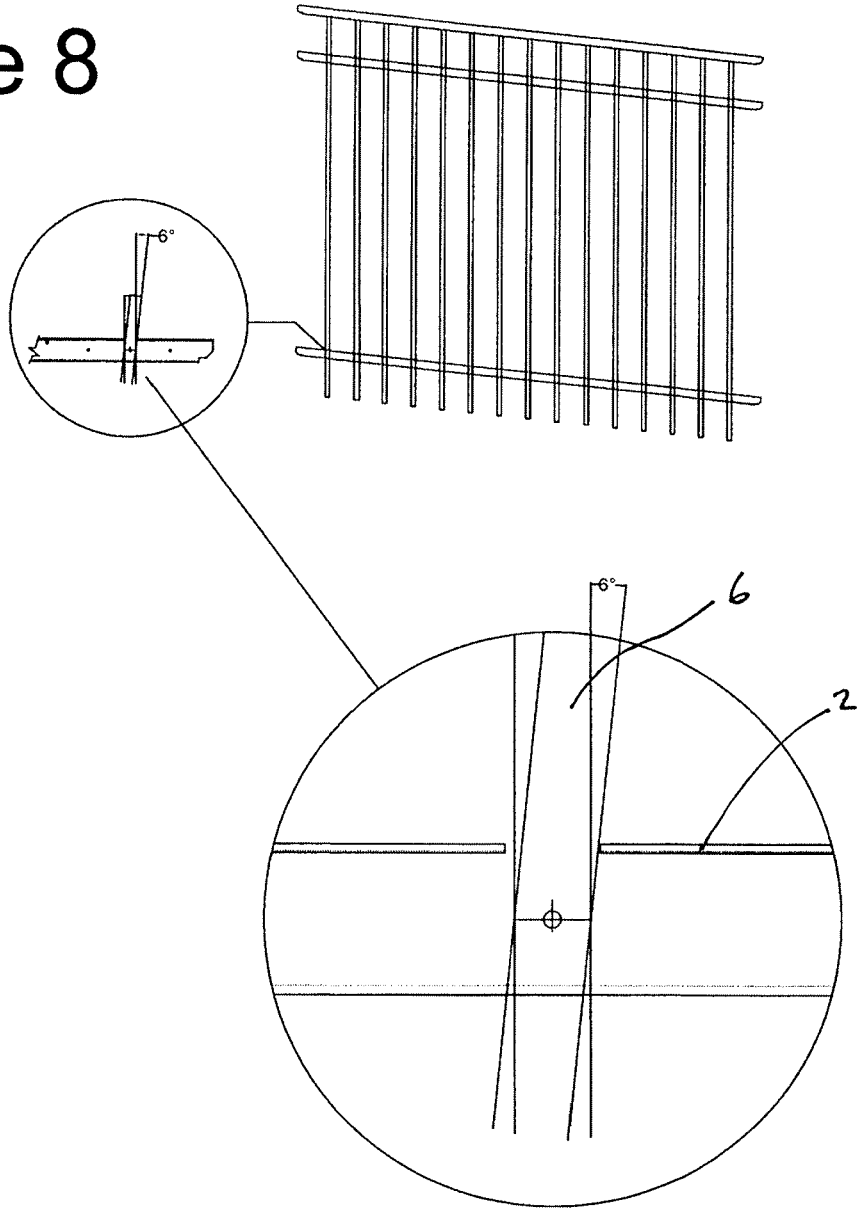
FIG. 8 is a perspective view of a racked fence showing pickets fastened near the middle of a rail.

FIGS. 7 and 8 compare the different fastening positions of the picket and rail. FIG. 8 shows pickets 6 fastened to the middle of the stringer rail 2 while FIG. 7 shows pickets 6 fastened near the top of the stringer rail 2. With openings in the top web of the stringer rail that are roughly the same size, pickets fastened near the top of the stringer rail provide a much greater range of motion than pickets fastened at the middle of the stringer rail. Specifically, FIG. 7 shows that pickets secured near the top of the stringer rail can rotate up to 22 degrees from the vertical without requiring wider stamping, while FIG. 8 shows that pickets secured at the middle of the stringer rail can rotate only up to 6 degrees from the vertical without requiring additional stamping, even though the punched openings through which the pickets extend are the same size.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

That which is claimed:

1. A fence comprising two rails, where each rail comprises two sides and a top web, where one side comprises a rail lip, a rib, and a snap divot, where the rib extends perpendicularly from the one side and has an upper face, and where the snap divot has a bottom, a plurality of pickets, two fastener covers, where each fastener cover has a knuckle portion, a rib portion, and a snap dimple, where the rib portion extends perpendicularly from a side face and has a lower face, and where the snap dimple has a top, and a plurality of fasteners, where each picket is secured to the top of the two rails by means of the plurality of fasteners, where the fastener cover covers the fasteners that secure the pickets to the rails, where the upper face of the rib of the rail mates with the bottom face of the rib of the fastener cover, where the bottom of the snap divot of the rail mates with the top of the snap dimple of the fastener cover, whereby the mating of the ribs creates a compression point that allows the snap divot and snap dimple to snap together thus increasing the rigidity of the fastener cover and rail.

2. The fence of claim 1, wherein the fasteners are screws.

3. The fence of claim 1, further comprising a third rail and a third fastener cover, where each picket is secured to the top of the third rail by means of the plurality of fasteners, where the third fastener cover is secured to the third rail, where the third fastener cover covers the fasteners that secure the pickets to the third rail.

4. The fence of claim 1, further comprising two posts, where each end of each rail is secured to a post.

5. The fence of claim 1, wherein the rib of the fastener cover is located between the knuckle and the snap dimple.

6. A fence rail system comprising a rail, a picket, a fastener, and a fastener cover, where the rail comprises two sides and a top web, where one side comprises a rail lip, a rib, and a snap divot, where the snap divot has a bottom, where the fastener cover comprises a knuckle, a rib, and a snap dimple, where the snap dimple has a top, where the fastener cover mates with the rail to form a fastener chamber, wherein the bottom of the snap divot of the rail mates with the top of the snap dimple of the fastener cover, and where the fastener secures the picket to the top of the rail, where the one side of the rail has a bottom, where the snap divot is located on a lower face of the rail and where the snap dimple of the fastener cover extends beneath a bottom of the one side of the rail.

7. The fence rail system of claim 6, wherein the knuckle of the fastener cover mates with the rail lip of the rail.

8. The fence rail system of claim 6, where the rib of the rail has a top, where the rib of the fastener has a bottom, wherein the bottom of the rib of the fastener cover mates with the top of the rib of the rail.

9. The fence rail system of claim 6, wherein the knuckle of the fastener cover mates with the rail lip of the rail, and the rib of the fastener cover mates with the rib of the rail.

10. The fence rail system of claim 6, where the fastener extends into the fastener chamber.

11. The fence rail system of claim 6, wherein the fastener is a screw.

12. The fence rail system of claim 6, wherein the web of the rail is punched with one or more holes.

13. The fence of claim 6, wherein the rib of the fastener cover is located between the knuckle and the snap dimple.

14. A method of securing a picket to a rail comprising the steps of:

fastening a picket to the top of a rail, where the picket is fastened to the top of the rail by means of a fastener, where the rail comprises two sides and a web, and covering the fastener, where the fastener is covered with a fastener cover, where the fastener cover comprises a knuckle, a rib, and a snap dimple, where the snap dimple has a top, where one side of the rail comprises a rail lip, rib, and a snap divot, where the snap divot has a bottom, and where the fastener is covered by mating the top of the snap dimple to the bottom of the snap divot, where the one side of the rail has a bottom, where the snap divot is located on a lower face of the rail and where the snap dimple of the fastener cover extends beneath a bottom of the one side of the rail.

15. The method of claim 14, wherein the rib of the fastener cover has a bottom and the rib of the rail has a top, wherein the fastener is covered by further mating the knuckle of the fastener cover with the rail lip, and mating the bottom of the rib of the fastener cover to the top of the rib of the rail.

16. The method of claim 14, wherein the fastener is a screw.

17. The method of claim 14, wherein the fastener fastens the picket to the top of the rail.

18. The method of claim 14, further comprising the step of uncovering the fastener.

* * * * *